US005820110A

United States Patent [19]

Beu

[11] Patent Number: 5,820,110

[45] Date of Patent: Oct. 13, 1998

[54] SELF STORING GUARD RAIL SYSTEM FOR TELESCOPIC BLEACHERS

[75] Inventor: Roger H. Beu, Crystal Lake, Ill.

[73] Assignee: B & R Erectors, Inc., Woodstock, Ill.

[21] Appl. No.: 814,844

[22] Filed: Mar. 11, 1997

[51] Int. Cl.[6] ..... E04H 17/14

[52] U.S. Cl. ..... 256/59; 256/65; 256/26; 256/DIG. 2; 256/DIG. 6; 52/9; 52/183; 182/106; 182/113

[58] Field of Search ..... 256/59, 65, 24, 256/26, DIG. 2, DIG. 6, 1; 52/9; 182/106, 113

[56] References Cited

U.S. PATENT DOCUMENTS

| | | | |
|---|---|---|---|
| 2,738,913 | 3/1956 | Taylor | 182/106 |
| 3,342,458 | 9/1967 | Simonton | 256/24 |
| 3,747,706 | 7/1973 | Paine et al. | 52/9 X |
| 3,964,215 | 6/1976 | Hartman et al. . | |
| 4,006,564 | 2/1977 | Wiese | 52/9 |
| 4,014,522 | 3/1977 | Sutter . | |
| 4,030,255 | 6/1977 | Hartman . | |
| 4,361,991 | 12/1982 | Wiese | 52/9 |
| 4,571,895 | 2/1986 | Lyman, Jr. . | |
| 4,583,715 | 4/1986 | Wright | 256/24 |
| 4,615,277 | 10/1986 | De La Haye | 182/113 X |
| 4,909,483 | 3/1990 | Van Herpen | 256/59 |
| 4,997,165 | 3/1991 | Wiese . | |
| 5,069,007 | 12/1991 | Paddock . | |
| 5,356,119 | 10/1994 | Schock | 256/26 |
| 5,609,327 | 3/1997 | Amidon | 256/65 X |
| 5,647,451 | 7/1997 | Reichel | 256/DIG. 6 X |
| 5,667,199 | 9/1997 | Hamm | 256/59 X |

FOREIGN PATENT DOCUMENTS

| | | | |
|---|---|---|---|
| 4339705 | 5/1994 | Germany | 256/59 |

*Primary Examiner*—Daniel P. Stodola
*Assistant Examiner*—Bruce A. Lev
*Attorney, Agent, or Firm*—McCaleb, Lucas & Brugman

[57] ABSTRACT

A telescoping bleacher system having plural sectional rows of cantilever mounted seats and horizontal foot decks moveable between an extended use position whereat the rows are cascaded in descending order and a storage position in which the rows are superposed in vertical registration, and wherein plural guard rail units are permanently secured to the cantilever seats and foot decks for movement therewith between stored and extended positions; such guard rails being individually associated with each sectional row to provide vertically extending safety barriers across the exposed ends of the seats and foot decks and importantly operable to nest in a storage position within the foot well of each row without interfering with telescoping movements of the bleacher sections.

6 Claims, 4 Drawing Sheets

SELF STORING GUARD RAIL SYSTEM FOR TELESCOPIC BLEACHERS

This invention generally relates to safety handrails and more specifically concerns improvements in permanently mounted handrails useful with telescopic bleacher seating.

Prior known permanently attached guard rail systems for use with telescopic bleachers required considerable lateral clearance beyond the ends of the bleacher sections and in many instances overhead clearance of 40–50" or more above the top bleacher seat. Such clearance requirements greatly restricted the use of permanently attached guard rail systems with bleachers designed to store in a walled recess, as well as portable bleachers, due to restricted doorway or overhead clearance. These clearance problems were reduced somewhat by modifying the bleacher structures to reduce bleacher size and seat capacity to accommodate needed clearances. These practices, in many instances seriously compromised the original design integrity of the bleacher assemblies. In other instances, the bleacher location has been changed at great expense to insure necessary clearance. In still other instances heavy, cumbersome detachable or "drop in" style railings have been used, although such are far less desirable than permanently installed rails, because of the difficulty and expense of erecting and removing the drop in railings each time the bleachers are used. In addition, the installing personnel frequently are injured during the installation and dismantling operations.

SUMMARY OF THE INVENTION

The present invention provides a novel, permanently installed guard rail structure for use with telescopic bleachers which successfully overcomes the aforenoted shortcomings and limitations of prior art permanent guard rails.

In brief the guard rail structure of this invention permits normal operation of a telescopic, cantilever deck bleacher assembly while providing upright extending safety railings along the exposed ends of the seat and deck rows.

More specifically, the guard rail hereof is made up of a number of individual barrier units, one associated with the exposed ends of each sectional row of seats and foot decks in the bleacher assembly. Each barrier unit comprises a rigid base attachable across the outer end of an associated foot deck and related seat riser. The base extends in relative close adjacency upwardly past the exposed outer end of the foot deck to which it is attached and presents multiple coaxially aligned spaced hinge tubes receptive of hinge pins. A pair of pivotally joined barrier gates, one carrying cooperatively aligned hinge tubes at its lower end are connected to the base for limited movement about a horizontal hinge axis. Suitable locking pins serve to lock the gates in coplanar, upright positions atop the base. The pivotal interconnection of the barrier gates permit the gates to fold about a pivot axis into superposed relation.

By releasing the locking pins, the gates are free to move about the horizontal hinge axis at their lower ends, so that they may be folded downwardly to rest on top of the associated foot deck when it is desired to store the bleachers in retracted condition.

It is an important object of this invention to provide a new and improved guard rail structure for use with telescopic bleachers.

It is a further important object of this invention to provide an improved guard rail structure which is permanently installed on telescopic bleachers, but does not interfere with movement of the bleachers between extended and retracted positions.

It is another object of this invention to provide an self storing guard rail system which is permanently attached to a telescopic bleacher assembly and is distinguished by inbuilt features for positioning the rail system in an upright operating position or in a retracted storage position.

A still further object of this invention is to provide a guard rail system for use with telescopic bleachers which is easy to install and use and which avoids interference with the normal telescopic operation of the bleacher assembly.

Having thus described this invention, the above and further objects, features and advantages thereof will be recognized from the following detailed description of a preferred embodiment thereof illustrated in the accompanying drawings and representing the best mode presently contemplated for enabling those of normal skill in the art to practice this invention.

IN THE DRAWINGS

Figure 1:
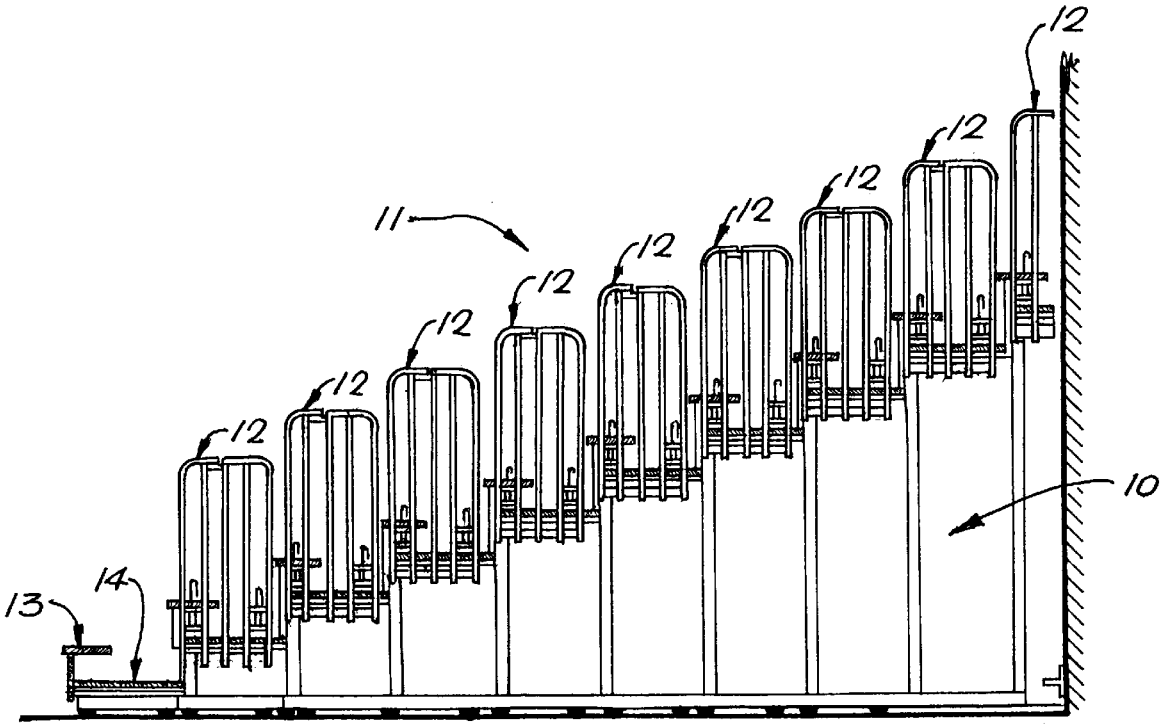
FIG. 1 is an end elevation of an extended telescopic bleacher fitted with the improved guard rail system of this invention.
Figure 3A:
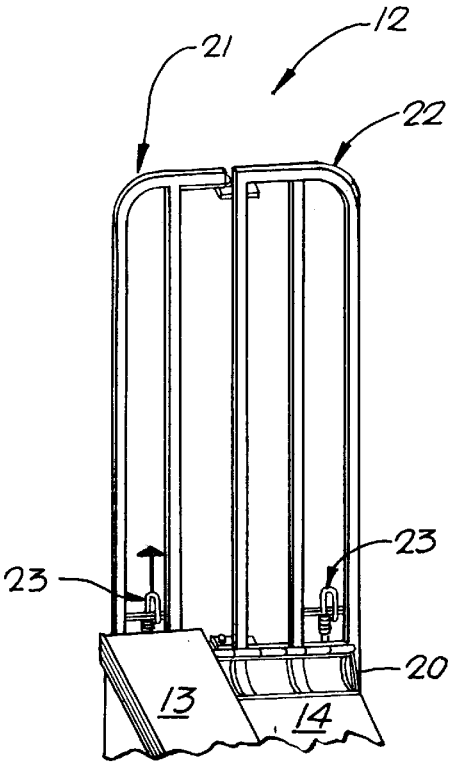
Figure 3B:
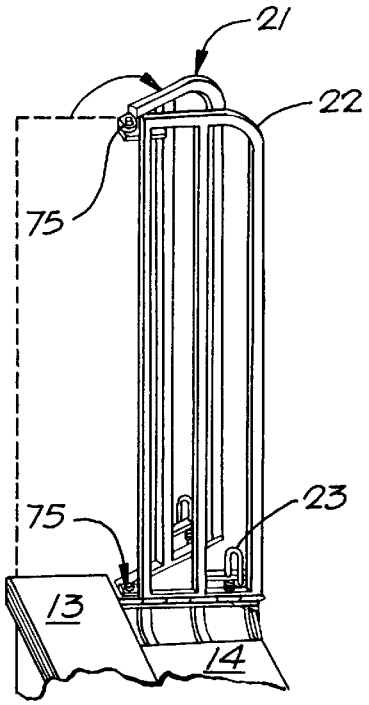
Figure 3C:
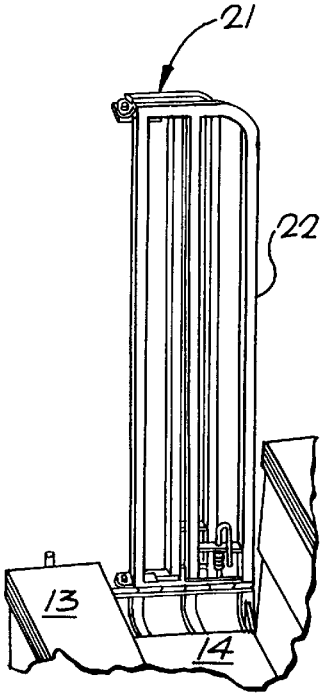
Figure 3D:
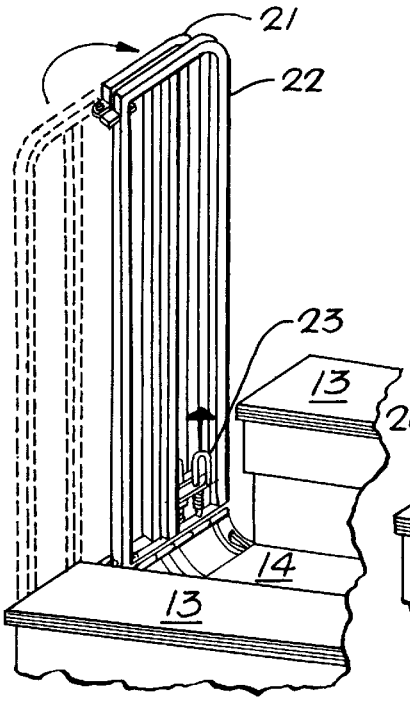
Figure 3E:
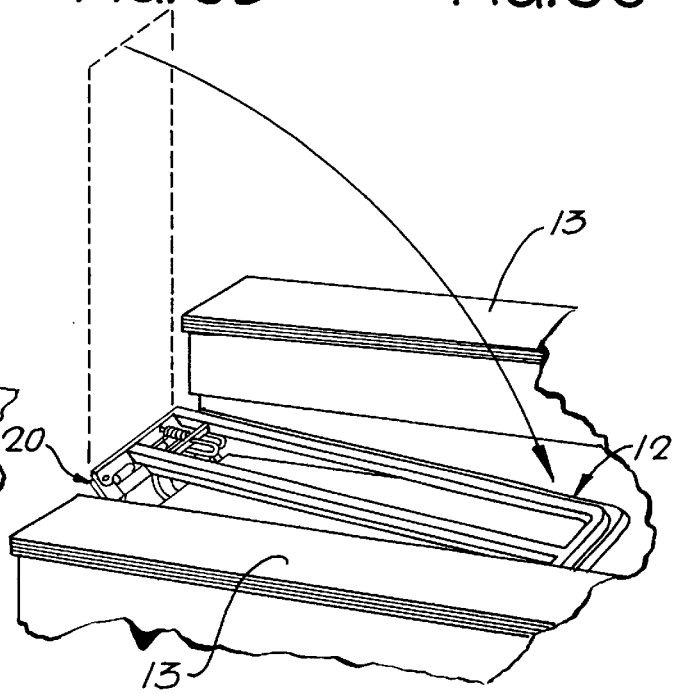
Figure 4:
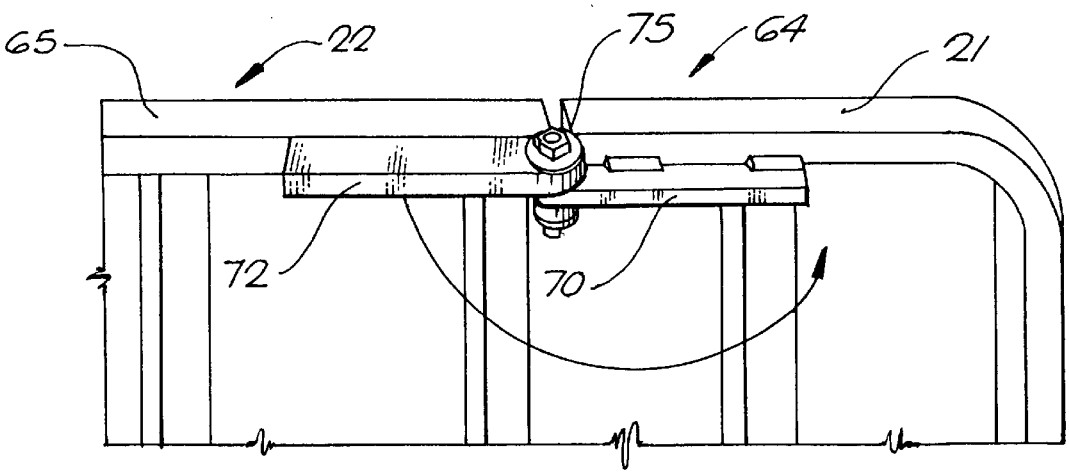
Figure 5:
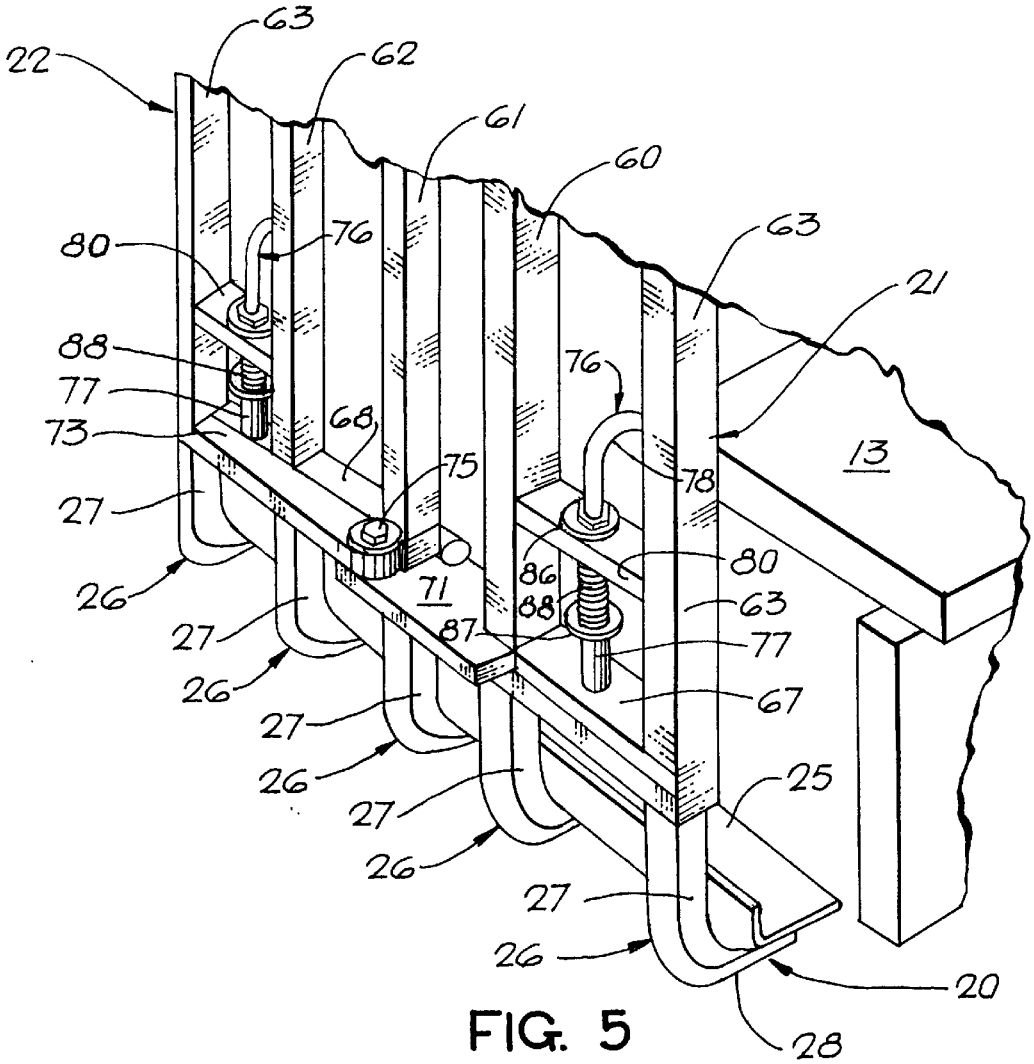
Figure 6:
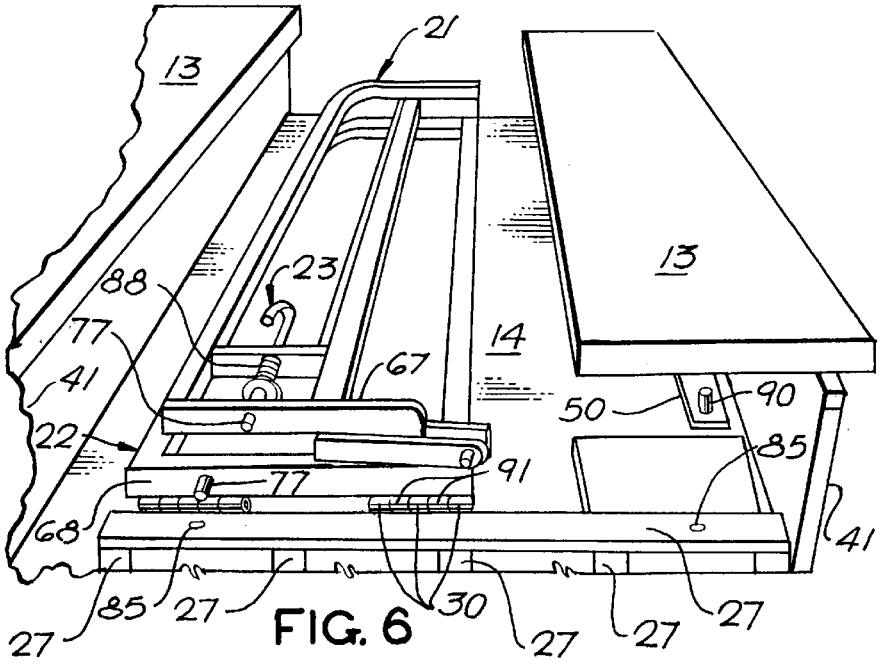
Figure 7:
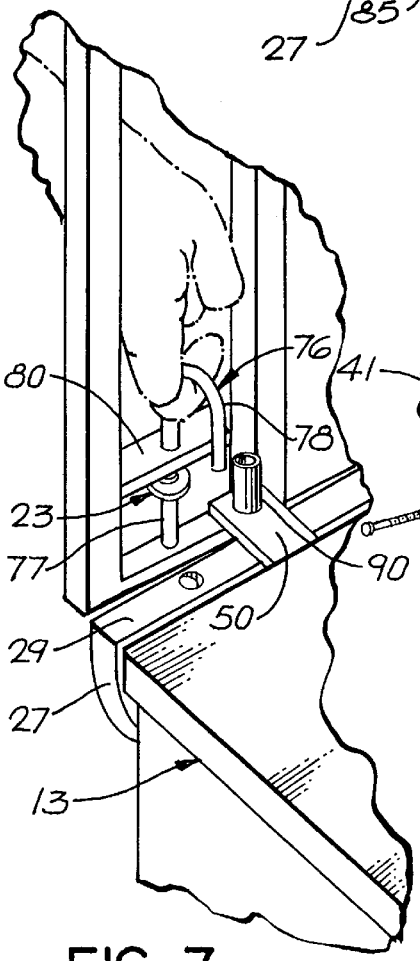
Figure 8:
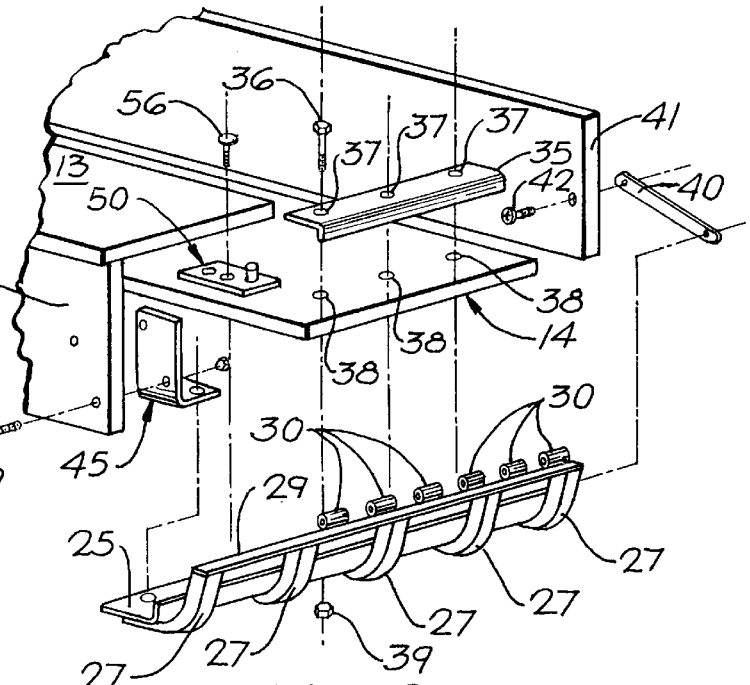

FIG. 3A–E are a series of perspective views illustrating the dismantling and storing of a mounted guard rail section of this invention;

FIG. 4 is an enlarged partial perspective looking downwardly at the outside upper end of a guard rail section shown in FIGS. 3A–E;

FIG. 5 is an enlarged partial perspective of the lower end of the guard section shown in FIG. 4 attached to the left hand end of the bleacher of FIG. 1;

FIG. 6 is another perspective of the left hand end of a bleacher section showing a guard section hereof folded to its stored state in a foot well;

FIG. 7 is an enlarged partial perspective of the lower end of a guard section illustrating a system for locking one gate of a guard rail section to an adjacent seat; and FIG. 8 is an exploded perspective view of the right hand end of a bleacher section showing the mounting base for supporting gates of each guard rail section according to this invention.

DESCRIPTION OF THE PREFERRED EMBODIMENT

With initial reference to FIG. 1 of the drawings it will be recognized that a telescopic bleacher assembly, indicated generally by 10, is shown in its extended state and fitted with a safety guard rail system 11, made up of a plurality of sectional guard rail units 12 individually associated with the open or exposed end or ends of each bleacher sectional row of cantilever suspended seats 13 and foot decks 14.

While the guard rail system 11 is comprised of a number of identical units 12, detailed description of one unit should suffice to impart the features of this invention to those of skill in the art. To that end, specific reference is now made to FIGS. 2–8 of the drawings setting forth the structural and operational features of each rail unit 12.

Figure 2:
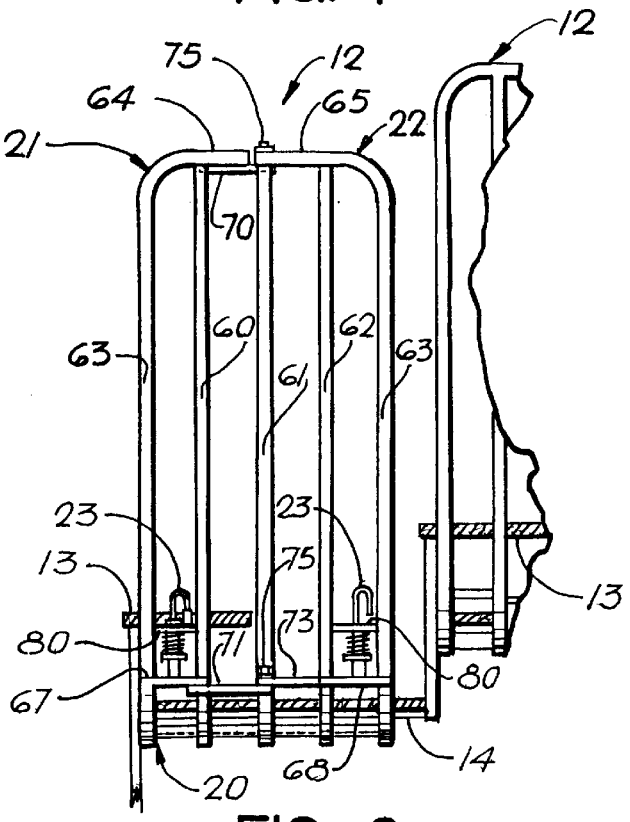
FIG. 2 is a partial, enlarged front elevation of adjacent guard rail sections in their mounted positions with bleacher foot deck and seat sections.

As will be understood best from FIG. 2, each rail unit 12 comprises a rigid mounting base 20, two upright rail sections 21, 22 and locking devices 23, one associated with each of the rail sections 21 and 22.

The features of the mounting base 20 are best shown in FIGS. 5 and 8. As seen in these figures a bottom mounting plate 25 of general L-shaped cross section is welded, or otherwise rigidly fixed to a plurality of tubular base rails 26, having a general L-shaped profile formed by integral tubular legs 27 having their lower ends curved and flatlined to provide, substantially planar arms 28 which are secured to the bottom side of the bottom mounting plate 25. The upper open ends of the tubular legs 27 are closed over by an overlying flat metal strap 29 welded to the several legs 27. Strap 29 carries a series of coaxial aligned hinge tubes 30 (three in the particular illustrated embodiment) which are welded in spaced relation for reception of cooperating hinge members, as will appear presently.

In order to fasten the bottom mounting plate 25 to the underside of the foot deck 14, a second top mounting plate 35 is used to engage the top and end faces of the foot deck. Plate 35 acts as a bearing plate for mounting bolts 36 which pass through openings 37 in plate 35, corresponding holes 38 in foot deck 14 and the bottom mounting plate (not shown). Nuts 39 cooperate with bolts 36 to anchor the two plates 25 and 35 in position (see FIG. 8). When so mounted on the foot deck, legs 27 thereof extend upwardly past the outer end of deck 14.

If additional support of mounting base 20 is needed, a reinforcing strap 40, may be employed; the strap being tied to a seat kick plate 41 and to one end of base 20 by bolt fasteners 42. Similarly an L-shaped front mounting bracket 45 may be attached by bolts 46 to the kick plate 41 of a forwardly located seat 13 and to the mounting plate 25 adjacent the front end of the base bracket 20.

A front latch plate receiver 50 is mounted on the underside of the forward seat 13 of each seat/foot deck section as by bolts 56 (see FIG. 8). This latch plate cooperates with a manually operable latch bolt lock 23 to be described more fully presently.

It will be recognized that the base 20 is the same for installation on both the right and left hand exposed ends of a bleacher assembly except for the location of the hinge tubes 30 (see FIGS. 6 and 8).

Turning now to the features and structure of the guard rail units 12, initial reference is made to FIGS. 1 and 2.

Basically each of the guard comprises, units 12 a plurality (three in the illustrated case) of linear tubular metal rails 60, 61, 62 of equal length (FIG. 2 configuration). A two piece border railing having two linear border reaches 63 paralleling rails 60–62 and right angularly related upper end reach portions 64 and 65 that extend over the upper ends of rail 60 and the two other rails 61 and 62, respectively, define the outer borders of rail sections 21 and 22 (see FIG. 2).

The border railing portions 64 and 65 are welded to the upper ends of associated rails 60–62. In similar fashion, the lower ends of rails 60 and the adjacent border rail reach 63 are welded to and cross connected by a metal strap 67 to unify the gate section 21. In like fashion, the lower ends of the rails 61, 62 and outer border reach 63 are welded to a cross connecting strap 68 to unify the gate section 22.

It will be noted that gate section 21 is pivotally joined to gate section 22 by means of a pair of extending pivot plates 70, 71 which are welded to the horizontal reach 64 and strap 67, respectively, of rail section 21 (see FIG. 5). The outer ends of such plates 70, 71 are pivotally joined to pivot support plates 72, 73 respectively, at the top and bottom ends of rail section 22. Bolt and nut fasteners 75 define a pivot axis for movement of rail section 21 relative to gate section 22, for reasons to be explained hereinafter.

As previously mentioned, rail sections 21, 22 are designed to lock in co-planar operating relation, as indicated in FIGS. 1 and 2. To that end, each gate is fitted with a locking device 23 made up of a locking pin 76 (see FIG. 5). Each locking pin has a linear cylindrical body 77, which is reentrantly turned over at one end to provide a hook like hand hold 78 (see FIG. 7).

Each locking pin is slidably mounted for movement through an opening in a strap bracket 80 fixed between two rails of each rail section. Thus strap 80 extends at right angles to and between outside railing reach 63 and rail 60 of rail section 21 while rail section 22 has strap 80 extending between its associated railing reach 63 and rail 62 (see FIG. 5). The lower end of locking pin body 77 of each locking device 23 is aligned to pass through openings in cross connecting straps 67 and 68 and lodge in aligned openings 85 in the mounting base strap 29 (see FIG. 6).

In order to provide thrusting force to the locking pin body 77; a pair of washers 86 and 87 are pinned to body 77 in spaced relation, washer 86 above the strap bracket 80 and washer 87 below bracket 80. A compression spring 88 surrounds the body and engages the lower side of bracket 80 and the upper side of washer 87. With this arrangement spring 88 serves to thrust the locking pin downwardly into the openings in the base strap 29. Removal of the pins from locking position is accomplished by pulling upwardly on the handle portion 78 of each locking pin, as exemplified in FIG. 7.

When locked in place the two rail sections 21, 22 of each rail unit 12 will be co-planar and generally vertically upright, as shown in FIGS. 1–3A. As illustrated in FIG. 7, in the event that the seat attached latch receiver 50 is utilized, the outer end of the latch handle associated with the locking device 23 on gate section 21, is inserted into a socket 90 on the receiver 50 to provide additional support to the erect gate structure.

It will be recalled that the base plate 29 is equipped with several tubular coaxially aligned spaced hinge tubes 30. As will be appreciated best from FIG. 6, cooperating male hinge tubes 91 welded to the bottom member 68 of rail section 22 interfit with tubes 30 to provide a tubular hinge joint completed by a linear hinge pin (not shown) reaching through the several tubes 30 and 91 in a known manner. With such hinged connection between rail section 22 and support base 20, limited folding movement of rail section 22 is readily available upon release of the locking devices 23 associated with the two rail sections, as illustrated in FIGS. 3A–E.

FIGS. 3A–E set forth a sequence of steps required to store the erected units 12 in non-interfering position in the bleacher foot wells so that the bleacher may be readily retracted to its stored condition.

FIG. 3A illustrates the erected position of a guard rail unit 12 according to this invention whereat its base 20 is secured to an exposed end of a foot deck 14 as previously described.

When it is desired to collapse a guard unit, as indicated in FIG. 3B, the locking device 23 of gate section 21 is released by raising the same vertically upward. Once this is accomplished, gate section 21 may be swung about its pivot axis defined by bolts 75. Eventually the gate section 21 will come to rest in superposed relation behind rail section 22, as seen in FIG. 3C.

Once the FIG. 3C positioning of the gate and rail section is achieved, as shown in FIG. 3D, raising pin 77 of the locking device 23 associated with rail section 22, permits the superposed sections to fold about the hinge connection between rail section 22 and base 20 as previously described. It should be recognized that such folding movement is limited to approximately a 90° arc toward the related foot deck until the folded rail sections rest atop the foot deck of the related bleacher sections (see FIG. 3E).

Thus the guard rail units of this invention are readily stored in unobtrusive positions within the foot wells of the bleacher sections so as to not interfere with extension and retraction movements of the bleacher assembly.

From the foregoing it is believed that those skilled in the art will readily recognize the novel advancement in the art provided by this invention and will understand that while this invention has been described in relation to a particular preferred embodiment illustrated in the drawings, various changes, modifications and substitutions of equivalents may be made therein without departing from the spirit and scope of this invention, which is intended to be unlimited by the foregoing except as may appear in the following appended claims.

The embodiments of the invention in which an exclusive property or privilege is claimed are defined as follows:

1. In a telescopic bleacher having plural sectional rows of cantilever mounted, parallel, horizontal seats and foot decks moveable between retracted and extended bleacher positions, a permanently installed self-storing safety handrail system comprising:

a plurality of guard rail units operable to provide a safety barrier across exposed open ends of each sectional row of telescopic bleacher seats and foot decks;

said guard rail units being moveable with said sectional rows of seats and foot decks;

each guard rail unit comprising a single, rigid unitary mounting base having means for attaching the same to opposite faces of an exposed end of an associated foot deck, a pair of generally rectangular, operationally vertical, upright guard rail sections, one of which has one end pivotally joined to said base for limited movement about a horizontal axis and the other of which is pivotally joined along one lateral margin to an adjacent lateral margin of said one of said sections whereby said other of said sections may be selectively folded about a vertical axis to superpose said one of said sections; said sections when superposed arranged for simultaneous folding movement about said horizontal axis to engage an associated footdeck, and a pair of manually operated spring biased latches, one fixedly mounted on each of said rail sections for locking said rail sections in co-planar upright operating positions.

2. The safety handrail of claim 1, and hinge means pivotally interjoining said base and one end of said one of said rail sections to provide limited movement of said superposed sections about said horizontal axis.

3. The safety handrail of claim 2, wherein the latch associated with said one of said sections operates to lock said one of said sections in upright position and when released permits said one of said sections to pivot about said horizontal axis to engage said associated foot deck.

4. The safety handrail of claim 3, wherein the latch associated with said other of said sections serves to lock said other of said sections to said base and an adjacent seat; release of said latch on said other of said rail sections permitting superpositioning of said rail sections whereby to move said sections simultaneously about said horizontal axis for storage on a foot deck of an associated bleacher section.

5. The safety handrail of claim 1, wherein said rail sections are co-planar and substantially vertical in said upright positions.

6. The safety handrail of claim 1, wherein each of said rail sections comprises plural parallel linear tubular rails bounded by a tubular border railing.

* * * * *

UNITED STATES PATENT AND TRADEMARK OFFICE

CERTIFICATE OF CORRECTION

PATENT NO. : 5,820,110

DATED : 10/13/98

INVENTOR(S) : Roger H. Beu

It is certified that error appears in the above-identified patent and that said Letters Patent is hereby corrected as shown below:

Col. 3, line 64, delete "gate" and insert -- rail --.

Signed and Sealed this

First Day of June, 1999

*Attest:*

Q. TODD DICKINSON

*Attesting Officer*

*Acting Commissioner of Patents and Trademarks*